US006326730B1

(12) United States Patent
Symons

(10) Patent No.: US 6,326,730 B1
(45) Date of Patent: Dec. 4, 2001

(54) LOW-POWER WIDE-BANDWIDTH KLYSTRON

(75) Inventor: Robert Spencer Symons, Los Altos, CA (US)

(73) Assignee: Litton Systems, Inc,, Woodland Hills, CA (US)

( * ) Notice: Subject to any disclaimer, the term of this patent is extended or adjusted under 35 U.S.C. 154(b) by 0 days.

(21) Appl. No.: 09/193,644

(22) Filed: Nov. 16, 1998

(51) Int. Cl.[7] ..... H01J 25/10
(52) U.S. Cl. ..... 315/5.39; 315/5.38
(58) Field of Search ..... 315/5.39, 39, 5.38

(56) References Cited

U.S. PATENT DOCUMENTS

| | | | | |
|---|---|---|---|---|
| 3,644,778 | * | 2/1972 | Mihran et al. | 315/5.38 |
| 3,725,721 | * | 4/1973 | Levin | 315/5.39 X |
| 3,902,098 | * | 8/1975 | Tanaka et al. | 315/5.39 |
| 3,904,917 | | 9/1975 | Ueda . | |
| 4,168,451 | * | 9/1979 | Kageyama et al. | 315/5.39 |
| 4,558,258 | | 12/1985 | Miyake . | |

OTHER PUBLICATIONS

"The Klystrode—An Unusual Transmitting Tube With Potential for UHF–TV" by Preist et al., Proceedings Of The IEEE, vol. 70, No. 11, Nov. 1982, pp. 1318–1325.

* cited by examiner

*Primary Examiner*—Benny T. Lee
(74) *Attorney, Agent, or Firm*—O'Melveny & Myers LLP

(57) ABSTRACT

A low-power wide-bandwidth klystron comprises a cathode having an electron emitting surface capable of emitting an electron beam and a collector spaced from said cathode and designed to collect the electron beam emitted from the cathode. An anode is disposed between the cathode and the collector in order to channel the electron beam into a series of drift tubes that define the electron beam path between the anode and the collector. The drift tubes define gaps in which the input cavity and output cavity interact with the electron beam. The input cavity velocity modulates the electron beam by way of a radio frequency input signal and the output cavity extracts the amplified radio frequency signal from the electron beam. The drift tubes may define additional gaps between the input cavity and output cavity for intermediate cavities that would provide additional amplification. A voltage potential, positive with respect to the cathode voltage potential, is applied to the anode in order to draw the electron beam from the emitting surface of the cathode and into the drift tubes. The anode voltage potential is much larger than required for the desired output power. The output cavity is overloaded by providing it with a load conductance that is at least twice that required for optimal klystron power output. A voltage potential, positive with respect to the cathode voltage potential, is applied to the collector, but the voltage potential difference between the cathode and the collector may be at most one half of a corresponding voltage potential difference between the cathode and the anode.

29 Claims, 3 Drawing Sheets

FIG. 3

| PARAMETERS | 0.012" Beam Conventional Klystron | 0.018" Beam Single-Stage Dep. Coll. Kly. | 0.026" Beam Single-Stage Dep. Coll. Kly. |
|---|---|---|---|
| Beam Perveance (amp/$V^{3/2}$) | $3x10^{-6}$ | $1x10^{-6}$ | $1x10^{-6}$ |
| Cathode to Collector Voltage (volts) | 1000 | 500 | 500 |
| Collector Current (amperes) | 0.085 | 0.332 | 0.332 |
| Collector Power (watts) | 85 | 166 | 166 |
| Cathode-to-Body Voltage (volts) | 1000 | 5000 | 5000 |
| Body Current (amperes) (est.) | 0.005 | 0.018 | 0.018 |
| Body Power (watts) (est.) | 5 | 90 | 90 |
| Beam Diameter (inches) | 0.012 | 0.018 | 0.026 |
| (radians) | 3.00 | 2.00 | 3.00 |
| Drift Tube Diameter (inches) | 0.016 | 0.022 | 0.032 |
| (radians) | 4.28 | 2.50 | 3.72 |
| Gap Length (inches) | 0.004 | 0.014 | 0.016 |
| (radians) | 1.0 | 1.58 | 1.86 |
| 4-Cavity Body Length (inches) (approximately one plasma wavelength) | 0.19 | 0.68 | 0.76 |
| Beam Current Density (Amp/$cm^2$) | 136 | 230 | 102 |
| Brillouin Field (gauss) | 3052 | 2659 | 1773 |
| Gap Coupling Coefficient | .471 | .603 | .368 |
| $\alpha$ = Normalized Gap Voltage for Max Po | 2 | N/A | N/A |
| $\zeta$ = Electron Energy Change/$V_b$ | 1 | 0.1 | 0.1 |
| $\eta$ = Bunching Efficiency (est.) | .2 | .4 | .4 |
| $R_L = \alpha^2 R_B/2\eta$ | 100,000 | N/A | N/A |
| $R_L = \zeta R_B/2M^2\eta$ | N/A | 4911 | 26372 |
| Cavity (R/Q) | 75 | 189 | 147 |
| 3 dB Bandwidth = (R/Q) $f/R_L$ (MHz) | 22 | 1154 | 166 |
| Power Output (watts) | 18 | 70 | 70 |

LOW-POWER WIDE-BANDWIDTH KLYSTRON

BACKGROUND OF THE INVENTION

1. Field of the Invention

The present invention relates to linear beam electron devices, and more particularly, to a low-power depressed-collector klystron that provides high efficiency and wide bandwidth.

2. Description of Related Art

Linear beam electron devices are used in sophisticated communication and radar systems which require amplification of a radio frequency (RF) or microwave electromagnetic signal. A conventional klystron is an example of a linear beam electron device used as a microwave amplifier. In a klystron, an electron beam originating from an electron gun is caused to propagate through a drift tube that passes across a number of gaps, each gap being part of a resonant cavity of the klystron. The electron beam is velocity modulated by a RF input signal introduced into the first one of the resonant cavities. The velocity modulation of the electron beam results in electron bunching due to electrons, that have had their velocity increased, gradually overtaking the electrons that have had their velocity decreased. The traveling electron bunches represent a RF current in the electron beam, which induces electromagnetic energy into subsequent resonant cavities. The electromagnetic energy may then be extracted from the last of the subsequent resonant cavities as an amplified RF output signal.

The bandwidth and efficiency of a klystron are both of considerable importance in klystrons. For example, the information rate of the signal the klystron can amplify increases with the bandwidth. Also, the power consumed by the klystron decreases as the efficiency increases.

The bandwidth of a klystron increases as the ratio of beam current to beam voltage increases, or rather, as the beam conductance is increased. This occurs because both the load conductance across the output cavity and the loading conductances that the beam produces on the intermediate cavities are proportional to the beam conductance. Therefore the quality factor (Q) for these cavities, which is a measure of the energy stored to the energy lost per cycle, decreases as the beam conductance is increased. Accordingly, bandwidth is also inversely proportional to Q.

The beam conductance is determined by the perveance of the electron gun, which produces it, and by the voltage at which the electron gun is operated. The perveance (K) is defined by the relationship between the beam current (I) and the beam voltage (V) as $I=K\ V^{3/2}$. The perveance is generally $1\times10^{-6}$ to $3\times10^{-6}$ amperes per volt$^{3/2}$ for the average klystron. The beam conductance (I/V) can thus be given by the expression $I/V=K\ V^{1/2}$.

In low-power klystrons, the beam voltage is usually low and the corresponding power output is typically less than 1 kilowatt. One approach to increasing the bandwidth would be to increase the perveance because, as discussed above, increasing the perveance increases the beam conductance and thus the bandwidth. However, this approach has two disadvantages. First, if the perveance is made high, there is an adverse impact on the efficiency of the tube because the space charge forces in the beam increase and make it difficult to tightly bunch the electrons of the beam. Second, as the perveance is increased at constant electron beam power, the beam voltage must be decreased. This results in a decrease in the electron beam velocity because the electron beam velocity is proportional to the square root of beam voltage. Furthermore, the dimensions of the cavity gaps along the beam must be held constant in terms of electron transit time to maintain good coupling of the cavity gap fields to the electrons. Therefore, the dimensions of these cavity gaps may become extremely small in low voltage klystrons, which are designed to operate at very high frequencies, and this results in difficulties in constructing a suitable klystron.

Accordingly, it would be desirable to provide an efficient klystron for low-power wide-bandwidth applications that could be easily fabricated. Furthermore, it would be desirable to provide a design methodology that would allow construction of various low-power klystrons for specific applications having relatively low output power and high efficiency, but with a much wider bandwidth and utilizing larger, more easily fabricated parts than would be found in a klystron of standard design.

SUMMARY OF THE INVENTION

In accordance with the teachings of the present invention, a klystron that operates at low power levels but that provides high efficiency and wide bandwidth is provided. Furthermore, the klystron provides low power, high efficiency, and wide bandwidth to meet specific design specifications while utilizing more easily fabricated parts than klystrons of conventional construction.

In an embodiment of the present invention, a low-power wide-bandwidth klystron comprises a cathode that has an electron beam emitting surface capable of emitting an electron beam therefrom and a collector spaced from the cathode. The collector collects the electron beam emitted from the cathode. An anode, disposed between the cathode and the collector, channels the electron beam emitted from the cathode towards the collector and past an input cavity and an output cavity. A drift tube, disposed around the electron beam, couples the input cavity and the output cavity together and defines a path for the electron beam. At least one intermediate cavity may be disposed along the electron beam between the input cavity and the output cavity. The input cavity velocity modulates the electron beam while the output cavity extracts the amplified signal from the electron beam. The output cavity is overloaded by providing it with a load conductance that is at least twice that required for an optimal power output of the klystron.

More particularly, a first voltage, positive with respect to the cathode, is applied to the anode in order to draw the electron beam from the cathode emitting surface. A second voltage, positive with respect to the cathode, is applied to the collector in order for the electron beam to reach it for collection, but the cathode to collector voltage potential difference may be at most one half of the cathode to anode voltage potential difference so that increased efficiency is achieved. The anode voltage, higher than that required for the desired power output, along with the large output cavity load conductance, provide low-power wide-bandwidth klystron performance.

A more complete understanding of the low-power wide-bandwidth klystron will be afforded to those skilled in the art, as well as a realization of additional advantages and objects thereof, by a consideration of the following detailed description of the preferred embodiment. Reference will be made to the appended sheets of drawings, which will first be described briefly.

BRIEF DESCRIPTION OF THE DRAWINGS

FIG. 3 is a table outlining specific examples of embodiments of low-power wide-bandwidth klystrons compared to a conventional klystron.

DETAILED DESCRIPTION OF THE PREFERRED EMBODIMENT

The present invention satisfies the need for a klystron having low-power requirements but that provides wide-bandwidth amplification while operating at high efficiency. Furthermore, the low-power wide-bandwidth klystron would allow construction utilizing more easily fabricated parts than klystrons of standard design with similar operating requirements. In the detailed description that follows, like element numerals are used to describe like elements illustrated in one or more of the figures.

Figure 1:
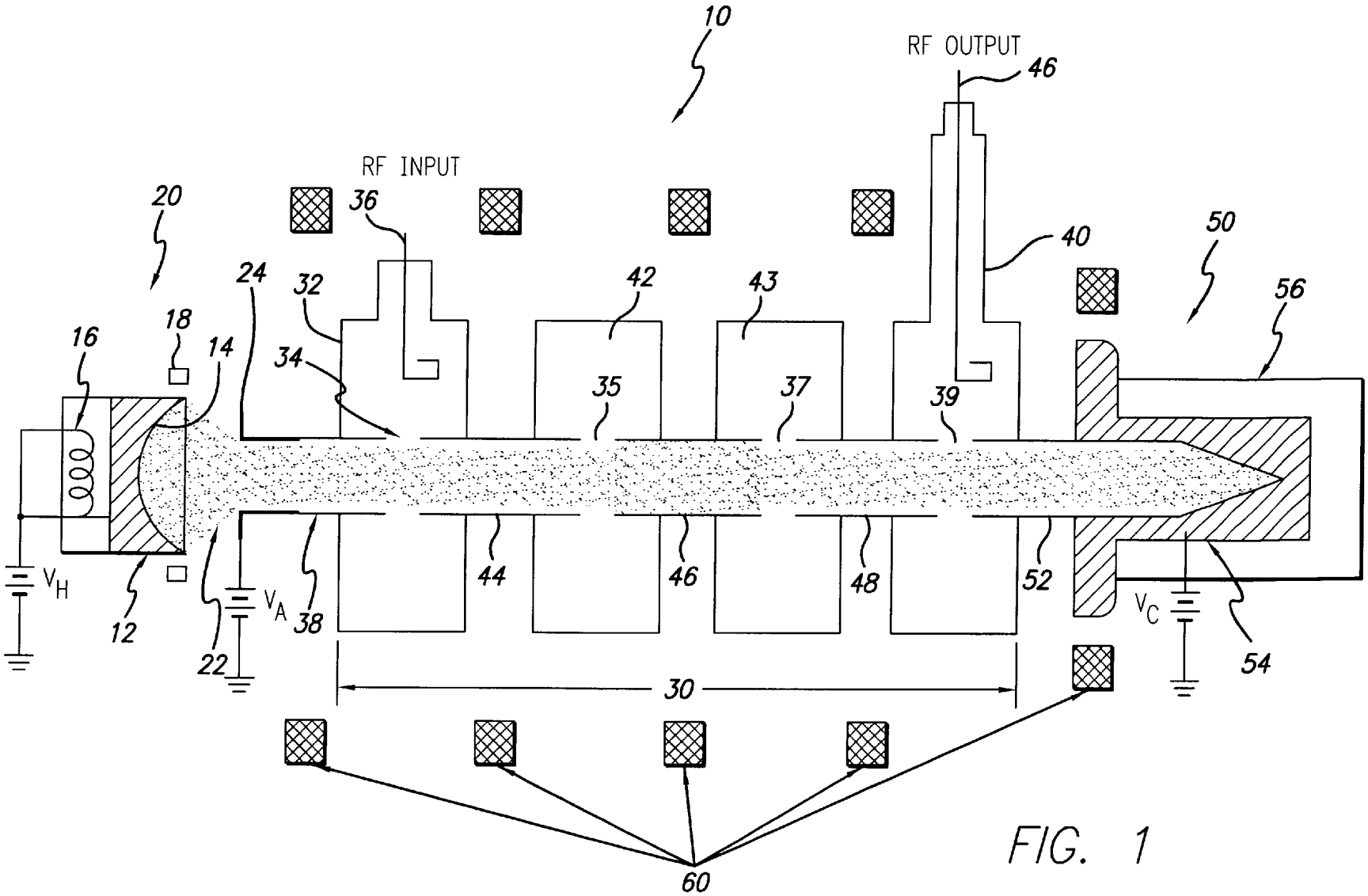
FIG. 1 is a side sectional view of a low-power wide-bandwidth klystron in accordance with an embodiment of the present invention.

Referring first to FIG. 1, a klystron 10 in accordance with an embodiment of the present invention is illustrated. The klystron 10 includes an electron gun section 20, radio frequency (RF) interaction section 30, and collector section 50. The electron gun section 20 includes a cathode 12 having a concave electron emitting surface 14. A heater coil 16 within the cathode 12 is electrically coupled to an external direct current (DC) or alternating current (AC) power source (VH). As known in the art, the heater coil 16 is used to raise the temperature of the cathode sufficiently to permit thermionic emission of electrons from the surface 14. An annular focus electrode 18 is disposed concentrically around the outer peripheral portion of the cathode surface 14.

An anode 24 defines an annular opening through which the electron beam 22 will travel. A positive voltage potential with respect to the cathode 12 is applied by an anode voltage source ($V_A$) to the anode 24 to define an electric field between the cathode surface 14 and the anode 24. The cathode 12 and focus electrode 18 are commonly coupled together at ground voltage potential. Alternatively, anode 24 could be coupled to ground and a negative voltage potential with respect to the anode 24 could be applied to the cathode 12 and focus electrode 18. Anode 24 draws the electrons from the cathode 12, focuses the electrons into an electron beam 22, and accelerates the electron beam 22 into the RF interaction section 30.

The RF interaction section 30 comprises a series of cavities that interact with the electron beam 22 as it travels from the electron gun 20 to collector section 50. Specifically, RF interaction section 30 includes input cavity 32, drift tubes 38, 44, 46, 48, 52, an optional series of intermediate cavities 42, 43, to increase gain or amplification, and output cavity 40. Input cavity 32 includes an inductive coupler 36 to couple an electromagnetic signal (RF Input) into the input cavity 32. Output cavity 40 includes an inductive coupler 46 to couple an electromagnetic signal (RF Output) out of the output cavity 40. The inductive coupler 36, 46, may utilize an iris or loop. Alternatively, capacitive coupling may be utilized to couple the electromagnetic signal into and out of the cavities, as known in the art.

The drift tubes 38, 44, 46, 48, and 52 extend axially along the length of the klystron between the electron gun section 20 and the collector section 50 and serve to couple the various klystron elements together and provide a path for the electron beam 22. Drift tube 38 is disposed between anode 24 and input cavity 32, drift tube 44 is disposed between input cavity 32 and intermediate cavity 42, drift tube 46 is disposed between intermediate cavity 42 and intermediate cavity 43, drift tube 48 is disposed between intermediate cavity 43 and output cavity 40, and drift tube 52 is disposed between output cavity 40 and collector section 50. An input gap 34 for input cavity 32 is defined between the respective ends of drift tubes 38, 44, intermediate cavity gaps 35, 37 are defined between the respective ends of drift tubes 44, 46 and drift tubes 46, 48, respectively, and output gap 39 is defined between the respective ends of drift tubes 48, 52. The gaps that define the cavity openings allow interaction between the RF signal and the electron beam 22 which results in the amplification of the RF signal. A magnetic field defined axially along the length of the klystron may also be provided to maintain the focus of the electron beam 22 by use of magnetic coils 60 or permanent magnets as known in the art.

The collector section 50 collects the electron beam 22 at the end of the RF interaction section 30. The electrons of the beam pass output gap 39, through drift tube 52, and enter collector 54 which collects the electrons. A positive voltage potential with respect to cathode 12 is applied by a collector voltage source ($V_C$) to the collector 54. Collector 54 is enclosed by coolant wall 56 which contains a coolant fluid and may additionally be supplied by a coolant reservoir (not shown) in order to circulate the coolant fluid around the collector 54. Additional heat radiating members such as fins may also be utilized to further improve heat conductance from the klystron.

In operation of the klystron, a positive voltage potential ($V_A$) with respect to the cathode is applied to the anode 24 resulting in the electrons, that have been thermionically emitted, being drawn from the cathode surface 14 and into drift tube 38. The electron beam 22 continues to travel through the respective ones of the drift tubes 44, 46, 48, and 52 and are transported therethrough in a compressed manner by operation of a focusing magnetic field defined axially along the length of the klystron. The electron beam 22 is ultimately deposited in the collector 54, having a positive voltage potential ($V_C$), where the electron beam diverges due to the space charge forces.

An RF input signal is inductively coupled through inductive coupler 36 into the input cavity 32 and the electrons in electron beam 22 traversing the input cavity gap 34 become velocity modulated by the RF input signal. The electron bunching becomes reinforced as the electrons traverse the intermediate cavity gaps 35, 37 which increases the klystron gain. The electron bunches traversing the output cavity gap 39 induce an electromagnetic wave in the output cavity gap 40 which is extracted through the inductive coupler 46 as an amplified RF output signal. It should be appreciated that a greater or lesser number of intermediate cavities may be utilized to achieve desired amplification characteristics of a klystron.

In order to provide a low-power klystron that will provide high efficiency and wide bandwidth at high frequencies, the basic approach is to begin with a klystron design giving an average perveance of about $1\times10^{-6}$ amperes per volt$^{3/2}$. This will give a good efficiency of about 40 percent, but will provide a narrow bandwidth and a higher output than required when operated at a beam voltage ($V_A$) several times above that which would produce the desired output power. The higher beam voltage is advantageous because it allows for greater klystron cavity and gap dimensions for acceptable transit angles. The output cavity is then overloaded by making the load conductance at least twice as large as required for optimal klystron power output. This reduces the RF voltage at the output cavity gap 39 and reduces the power output of the klystron along with its efficiency while increasing the bandwidth in proportion to the load conductance.

Finally, the collector is depressed in order to restore the klystron's efficiency, as discussed in greater detail below.

Figure 2:
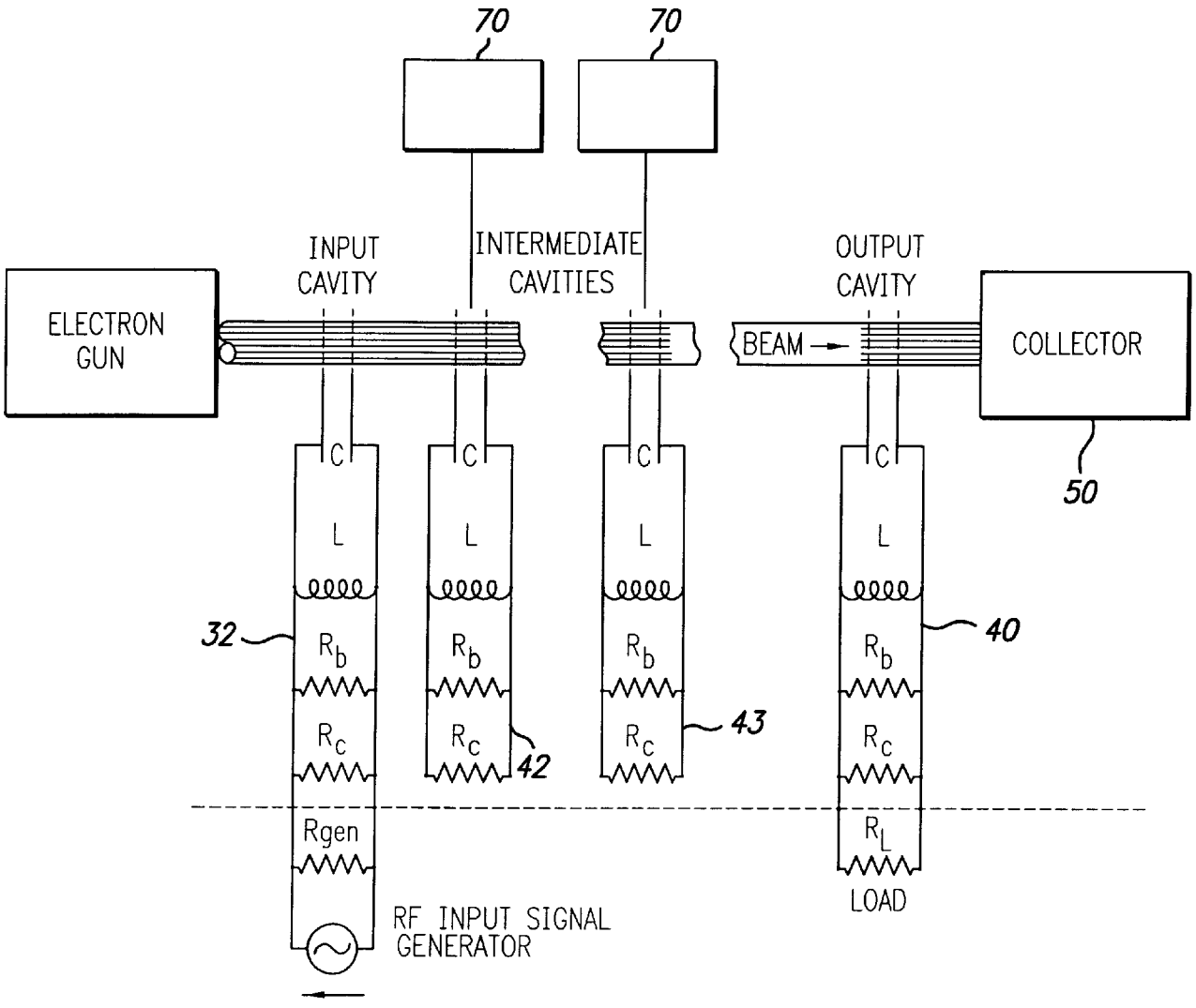
FIG. 2 is an electrical equivalent circuit diagram of a low-power wide-bandwidth klystron in accordance with an embodiment of the present invention.

FIG. 2 illustrates an electrical equivalent circuit diagram of a low-power wide-bandwidth klystron including an electron gun 20, a collector 50, and showing electrical equivalent circuits for input cavity 32, intermediate cavities 42, 43, and output cavity 40. The generic equivalent circuit for each cavity contains capacitance C, inductance L, electron beam resistance $R_b$, and cavity resistance $R_c$, with the input cavity 32 further including generator resistance $R_{gen}$. The dashed line separates the low-power wide-bandwidth klystron 10 from the external RF input signal generator and the external load $R_L$. The external RF input signal generator applies an RF input signal through inductive coupler 36 into input cavity 32 and external load $R_L$ represents the external load applied to output cavity 46 through inductive coupler 46.

As discussed above, by increasing the electron beam voltage ($V_A$) and making the output cavity load conductance ($1/R_L$) very large, the power output is reduced to the desired level and the bandwidth is increased in proportion to the beam conductance. Under these operating conditions, none of the electrons in the beam have all of their energy removed by the output cavity gap fields and therefore even the slowest electrons reach the klystron collector with a great deal of their energy remaining. This energy can then be recovered and the efficiency restored to typical klystron values by collecting the beam with a collector voltage potential ($V_C$) much closer to the cathode voltage potential than to the anode voltage potential ($V_A$). Very little of the current in a well focused electron beam will strike the anode, drift tubes, or cavities and therefore very little power will be taken from the anode voltage power supply.

Because of the increased beam current due to the higher than normal beam voltage for a klystron of this power rating, the beam loading on the intermediate cavities will be increased to a certain extent. However, it may be necessary to provide artificial loading 70, as shown in FIG. 2, on the intermediate cavities with suitable resistive material either inside the klystron or coupled to the intermediate cavities with various coupling devices such as irises, inductive loops, or capacitive probes as known in the art.

FIG. 3 shows a comparison of the various parameters of the klystron of preferred embodiments with the conventional klystron. Referring to FIG. 3, the various parameters include the beam perveance (amp/$V^{3/2}$), cathode-to-collector voltage (volts), collector current (amperes), collector power (watts), cathode-to-body voltage (volts), body current (amperes), body power (watts), beam diameter (inches), drift tube diameter (inches), gap length (inches), 4-cavity body length (inches), beam current density (amp/$cm^2$), Brillouin field (gauss), and the gap coupling coefficient. Other parameters include a, which is the normalized gap voltage for max $P_0$, $\zeta$, which is the electron energy change/$V_b$, $\eta$, which is the bunching efficiency, $R_L$, which equals to $\alpha^2 R_B/2\eta$, the cavity R/Q, the 3 dB bandwidth, and the power output.

The advantages of building a single-stage depressed-collector klystron in order to obtain large bandwidths at high frequencies, for example at approximately 30 GHz which is in the Ka frequency band, is shown in FIG. 3. Specifically, FIG. 3 tabulates the calculated relevant parameters for characteristics of a fairly conventional klystron with a beam perveance of $3\times10^{-6}$ A/$V^{3/2}$ and a beam diameter of 0.012". For comparison, FIG. 3 also tabulates the calculated relevant parameters for two embodiments of the present invention, identified as single stage depressed collector klystrons with perveance of $1\times10^{-6}$ A/$V^{3/2}$ and beam diameters of 0.018" and 0.026".

It can be seen that the conventional klystron has very little bandwidth (22 MHz) even though it has a fairly high perveance beam ($3\times10^{-6}$ A/$V^{3/2}$). This results from the fact that the cavity gap lengths (0.004") and the cavity heights (0.040") are very small and hence the cavities have low ratios of R/Q (outside cavity diameter for all designs is on the order of 0.200"). In addition, in spite of the small dimensions of the gap, the gap coupling coefficient is poor because, at the relatively low beam velocity associated with 1,000 volts, the gap dimensions are large in terms of electron transit time.

The single stage depressed collector klystron with the 0.018" beam diameter has smaller gaps in terms of transit angles even though they are physically larger (0.014") than the conventional klystron cavity gap lengths (0.004"). As a result, the gap coupling coefficients are larger and hence the load resistance that can be used on the output cavity and the Q can be considerably smaller. The R/Q of the cavity for this embodiment is also considerably higher (189 vs. 75) because the cavity is not nearly as flat as the cavity of the conventional perveance $3\times10^{-6}$ A/$V^{3/2}$ klystron (0.140" vs. 0.040") due to the longer length of the body. As a result, a 3 dB bandwidth of more than 1,000 MHz is available. The main disadvantage of this design is that the beam current density is rather high (230 A/$CM^2$) and a fairly high convergence ratio would have to be used on the electron gun, perhaps as high as 100:1. When stagger tuned to provide a broadband response, the gain would be fairly low (approximately 10 dB) for a four cavity klystron because of the heavy loading on the cavities.

When the electron beam of a single stage depressed collector klystron is increased to 0.026", as in the second embodiment of the present invention, the cathode current density problem is much less severe. However, as in the case of a conventional klystron, because of the large tunnel diameter, the gap coupling coefficient becomes quite low and the R/Q of the cavity is reduced because of the larger diameter drift tube. Hence only 166 MHz of bandwidth is available.

Having thus described preferred embodiments of a low-power wide-bandwidth klystron, it should be apparent to those skilled in the art that certain advantages of the within system have been achieved. It should also be appreciated that various modifications, adaptations, and alternative embodiments thereof may be made within the scope and spirit of the present invention. For example, several design examples have been illustrated, but it should be apparent that the inventive concepts described above would be equally applicable to many variations upon the described design. The invention is further defined by the following claims.

What is claimed is:

1. A low-power wide-bandwidth klystron, comprising:

a cathode having an electron emitting surface for emitting an electron beam;

a collector spaced from said cathode, said collector collecting electrons of said electron beam from said cathode;

an anode disposed between said cathode and said collector, said anode drawing said electron beam from said cathode;

an input cavity disposed between said anode and said collector and disposed along said electron beam, said input cavity velocity modulating said electron beam;

an output cavity disposed between said input cavity and said collector and disposed along said electron beam, said output cavity extracting energy from said electron beam that has been velocity modulated, said output cavity having a load conductance that is at least twice that required for an optimal power output of said klystron in order to provide increased bandwidth; and a drift tube disposed between said input cavity and said output cavity and disposed around said electron beam, said drift tube coupling said input and said output cavity to each other and defining a path for said electron beam.

2. The low-power wide-bandwidth klystron of claim 1, further comprising means for depressing said collector wherein said collector is coupled to a collector voltage source and said anode is coupled to an anode voltage source, and a first voltage potential difference between said cathode and said collector is at most one half of a corresponding second voltage potential difference between said cathode and said anode in order to provide increased klystron efficiency.

3. The low-power wide-bandwidth klystron of claim 1, further comprising a cathode voltage source coupled to said cathode and an anode voltage source coupled to said anode, wherein a cathode to anode voltage potential difference is larger than that required for a desired klystron power output.

4. The low-power wide-bandwidth klystron of claim 1, wherein said klystron operates at a frequency greater than 13 GHz.

5. The low-power wide-bandwidth klystron of claim 1, further comprising means for focusing said electron beam by generating a magnetic field along a path of said electron beam.

6. The low-power wide-bandwidth klystron of claim 1, further comprising means for providing an input signal to said input cavity.

7. The low-power wide-bandwidth klystron of claim 1, further comprising means for extracting an output signal from said output cavity in order to recover an amplified output signal.

8. The low-power wide-bandwidth klystron of claim 1, further comprising at least one intermediate cavity disposed along said electron beam between said input cavity and said output cavity.

9. The low-power wide-bandwidth klystron of claim 8, further comprising means for artificially loading said at least one intermediate cavity in order to increase bandwidth of said klystron.

10. The low-power wide-bandwidth klystron of claim 9, wherein said artificial loading means comprises internal resistive material.

11. The low-power wide-bandwidth klystron of claim 9, wherein said artificial loading means comprises an external coupling iris.

12. The low-power wide-bandwidth klystron of claim 9, wherein said artificial loading means comprises an inductive loop.

13. The low-power wide-bandwidth klystron of claim 9, wherein said artificial loading means comprises a capacitive probe.

14. A low-power wide-bandwidth klystron, comprising:

a cathode having an electron emitting surface for emitting an electron beam;

a collector spaced from said cathode, said collector coupled to a collector voltage source in order to collect said electron beam from said cathode;

an anode disposed between said cathode and said collector, said anode coupled to an anode voltage source in order to draw said electron beam from said cathode, an input cavity disposed between said anode and said collector and disposed axially along said electron beam, said input cavity coupled to an input signal to velocity modulate said electron beam;

an output cavity disposed between said input cavity and said collector and disposed axially along said electron beam, said output cavity coupled to means for extracting an output signal from said electron beam, said output cavity further having a load conductance that is at least twice that required for an optimal power output of said klystron; and a drift tube disposed between said input cavity and said output cavity and disposed axially around said electron beam, said drift tube coupling said input and said output cavity to each other and defining a path for said electron beam.

15. The low-power wide-bandwidth klystron of claim 14, further comprising means for depressing said collector wherein said cathode is coupled to a cathode voltage source, and a first voltage potential difference between said cathode and said collector is at most one half of a corresponding second voltage potential difference between said cathode and said anode in order to provide increased klystron efficiency.

16. The low-power wide-bandwidth klystron of claim 14, further comprising a cathode voltage source coupled to said cathode, and wherein a cathode to anode voltage potential difference is larger than that required for a desired klystron power output.

17. The low-power wide-bandwidth klystron of claim 14, wherein said klystron operates at a frequency greater than 13 GHz.

18. The low-power wide-bandwidth klystron of claim 14, further comprising means for focusing said electron beam by forming a magnetic field along a path of said electron beam.

19. The low-power wide-bandwidth klystron of claim 14, further comprising at least one intermediate cavity disposed along said electron beam between said input cavity and said output cavity, said at least one intermediate cavity having means for providing a proper load conductance.

20. The low-power wide-bandwidth klystron of claim 19, further comprising means for artificially loading said at least one intermediate cavity disposed along said electron beam between said input cavity and said output cavity.

21. The low-power wide-bandwidth klystron of claim 20, wherein said artificial loading means comprises internal resistive material.

22. The low-power wide-bandwidth klystron of claim 20, wherein said artificial loading means comprises external coupling means.

23. The low-power wide-bandwidth klystron of claim 19, further comprising a plurality of drift tubes, said drift tubes disposed along said electron beam path and coupling said anode, said input cavity, said at least one intermediate cavity, said output cavity, and said collector to each other and defining a respective drift gap across said input cavity, said at least one intermediate cavity, and said output cavity.

24. In a klystron, comprising a cathode having an electron emitting surface, means for inducing electron emission from said electron emitting surface, a collector spaced from said cathode and which collects electrons emitted from said electron emitting surface, an anode disposed between said cathode and said collector and which draws electrons emitted from said electron emitting surface into an electron beam, a first voltage potential applied to said anode, a second voltage potential applied to said collector, an input cavity disposed between said anode and said collector and disposed along said electron beam, said input cavity coupled to means for providing an input signal to velocity modulate said electron beam, an output cavity disposed between said input cavity and said collector and disposed along said electron beam, said output cavity coupled to means for extracting an output signal, a series of drift tubes respectively disposed between said anode and said input cavity, said input cavity and said output cavity, and said output cavity and said collector, said series of drift tubes respectively coupling said anode to said input cavity, said input cavity to said output cavity, and said output cavity to said collector and defining a path for said electron beam, a method for providing low-power, wide-bandwidth, and high efficiency, comprising the steps of:

overloading said output cavity by providing said output cavity with a load conductance that is at least twice that required for an optimal power output of said klystron;

increasing said first voltage potential so that an electron beam voltage is much larger than that required for a desired power output; and depressing said collector by making said second voltage potential closer to a voltage potential of said cathode than the first voltage potential of said anode.

25. The method of claim 24, wherein a cathode to collector voltage potential difference is at most one half of a cathode to anode voltage potential difference.

26. The method of claim 24, wherein said klystron operates at a frequency greater than 13 GHz.

27. The method of claim 24, further comprising means for focusing said electron beam by forming a magnetic field along a path of said electron beam.

28. The method of claim 24, further comprising at least one intermediate cavity disposed along said electron beam between said input cavity and said output cavity.

29. The method of claim 28, further comprising means for artificially loading said at least one intermediate cavity in order to increase bandwidth.

* * * * *